US005655314A

United States Patent [19]

Petracci

[11] Patent Number: 5,655,314

[45] Date of Patent: Aug. 12, 1997

[54] MOULDED SHOE SOLE ABLE TO TAKE IN AIR FROM THE INSIDE OF THE SHOE AND PUSH IT OUT FROM THE HEEL

[75] Inventor: Alfonso Petracci, Monte San Giusto, Italy

[73] Assignee: Petris - S.p.A., Italy

[21] Appl. No.: 595,176

[22] Filed: Feb. 1, 1996

[30] Foreign Application Priority Data

Mar. 17, 1995 [IT] Italy ..... AN95A0016

[51] Int. Cl.[6] ..... A43B 7/08

[52] U.S. Cl. ..... 36/3 B; 36/3 R

[58] Field of Search ..... 36/3 B, 3 A, 3 R

[56] References Cited

U.S. PATENT DOCUMENTS

| | | | |
|---|---|---|---|
| Re. 11,694 | 9/1898 | Kennedy | 36/3 B |
| 55,247 | 6/1866 | Daggett | 36/3 B |
| 616,112 | 12/1898 | Kennedy | 36/3 R |
| 655,576 | 8/1900 | Pearson | 36/3 R |
| 825,515 | 7/1906 | Byrne et al. | 36/3 B X |
| 989,894 | 4/1911 | Byrne | 36/3 B X |
| 1,981,300 | 11/1934 | Berg | 36/3 B |
| 2,558,973 | 7/1951 | Meaker | 36/3 R |
| 3,331,146 | 7/1967 | Karras | 36/3 R X |
| 4,654,982 | 4/1987 | Lee | 36/3 B X |
| 4,860,463 | 8/1989 | Pin | 36/3 B |
| 5,175,946 | 1/1993 | Tsai | 36/3 B X |
| 5,224,277 | 7/1993 | Sang Do | 36/3 B X |
| 5,477,626 | 12/1995 | Kwon | 36/3 R X |
| 5,515,622 | 5/1996 | Lee | 36/3 B X |

*Primary Examiner*—Ted Kavanaugh
*Attorney, Agent, or Firm*—Leonard Bloom

[57] ABSTRACT

A molded sole takes air in from the inside of the shoe and expels it through the heel, due to the pumping action carried out by a cushion, able to elastically deform once the foot pressure is applied. The cushion is housed within a chamber on the bottom of the sole and communicates through a longitudinal channel blocked by a single acting valve, with a ring on the heel which communicates with the interior through a vent area.

4 Claims, 2 Drawing Sheets

MOULDED SHOE SOLE ABLE TO TAKE IN AIR FROM THE INSIDE OF THE SHOE AND PUSH IT OUT FROM THE HEEL

BACKGROUND OF THE INVENTION

1. Field of the Invention

The present invention relates to a moulded shoe sole, able to take in air from the inside of the shoe so as to allow the foot to breathe in an effective and beneficial manner.

2. Description of the Prior Art

It is known, in fact that it is impossible for a foot inside a closed shoe to get sufficient air, so much so, that in cases of excessive perspiration, the skin becomes increasingly sensitive, often to the extent that the skin's aspect is altered. It would be highly desirable to increase the comfort of closed shoes, which are usually unable to allow the foot to breathe properly.

SUMMARY OF THE INVENTION

It is, therefore, an object of the present invention to provide the sole with ventilating features which would provide an increased hygiene and comfort to a person wearing shoes.

According to the teaching of the present invention, an integral sole in the shoe has a pumping chamber extending substantially the front area of the sole.

The rear area (or heel) of the sole has a ring, and rigid ribs extend between the pumping chamber and the ring. The pumping chamber communicates with the ring on the heel through a central channel extending longitudinally between the rigid ribs towards the ring at the heel area and conducting the air in one direction—from the pumping chamber towards the rear of the heel for being exhausted therefrom.

The sole, according to the invention, in spite of the fact that it appears to be like a moulded sole of the conventional type, is able to take in air from the inside of the shoe and expel it to the outside by means of the central discharge channel which runs longitudinally along the sole itself and comes to an end on a vent positioned at the heel. A deformable cushion covers the pumping chamber.

The suction action is obtained by means of the cushion, which deforms elastically. The cushion is subjected to repeated contractions as a result of the pressing action carried out by the ball of the foot when the person walking.

In practice, this cushion effectively carries out a pumping action, of the type produced by a simple piston, creating an intermittent air flow which passes through the inside of the shoe from the heel to the toe, from where the air taken in flows into the sole underneath, going along its longitudinal channel in the opposite direction until it reaches the aforementioned vent, positioned on the back of the heel.

The mouth of the central channel is blocked by a single acting valve, which lets the air through on its way to the heel, but also prevents this air from flowing back towards the toe.

More precisely, when the aforementioned cushion is squashed by the foot, the air contained in the chamber underneath the cushion is sufficiently compressed to open and pass through the single acting valve; when the foot does not exert the weight of the body on the cushion, it tends due to its elasticity, and in contrast to its previously compressed position, to push back up again, thereby creating a slight hollow in the chamber below it.

This hollow causes air to be reclaimed exclusively from the inside of the shoe, due to the fact that the single acting valve prevents any outside air from being sucked back in and from flowing within said suction chamber.

The elastic deformation of the cushion, which is absolutely necessary in order to obtain the pump effect just described, indirectly provides the foot with a soft resting surface, able to absorb any impact the ball of the foot may have with the ground.

BRIEF DESCRIPTION OF THE DRAWINGS

For further clarity of explanation, the description continues with reference to the attached drawings, reproduced for illustrative and not limitative purposes, wherein.

DESCRIPTION OF THE PREFERRED EMBODIMENT

Figure 5:
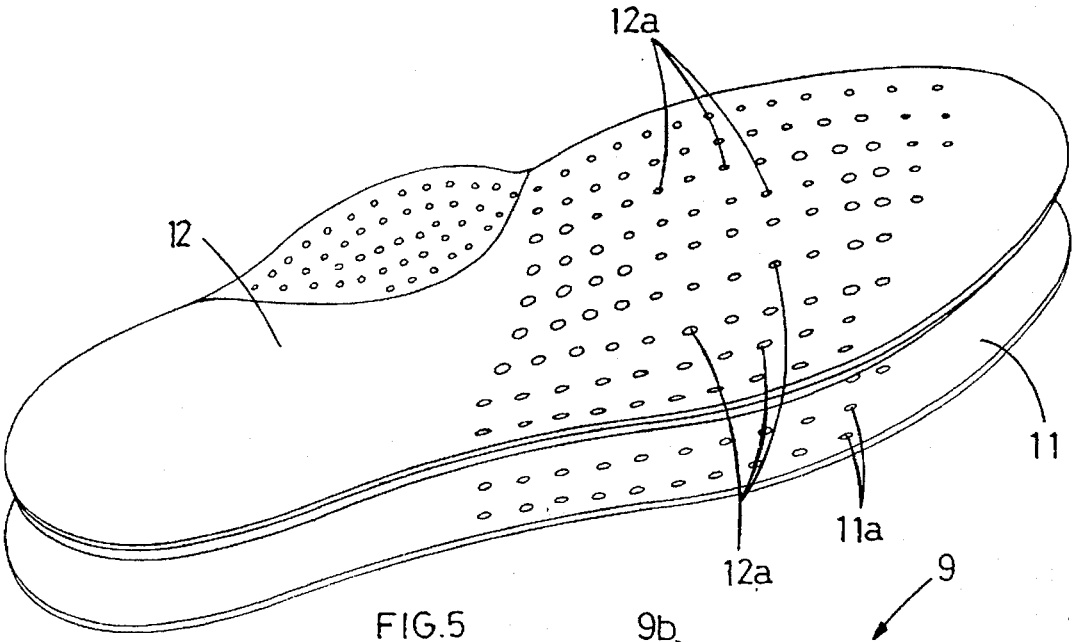
FIG. 5 shows the fitted and hygienic inner sole used in combination with the sole according to the present invention.
Figure 1:
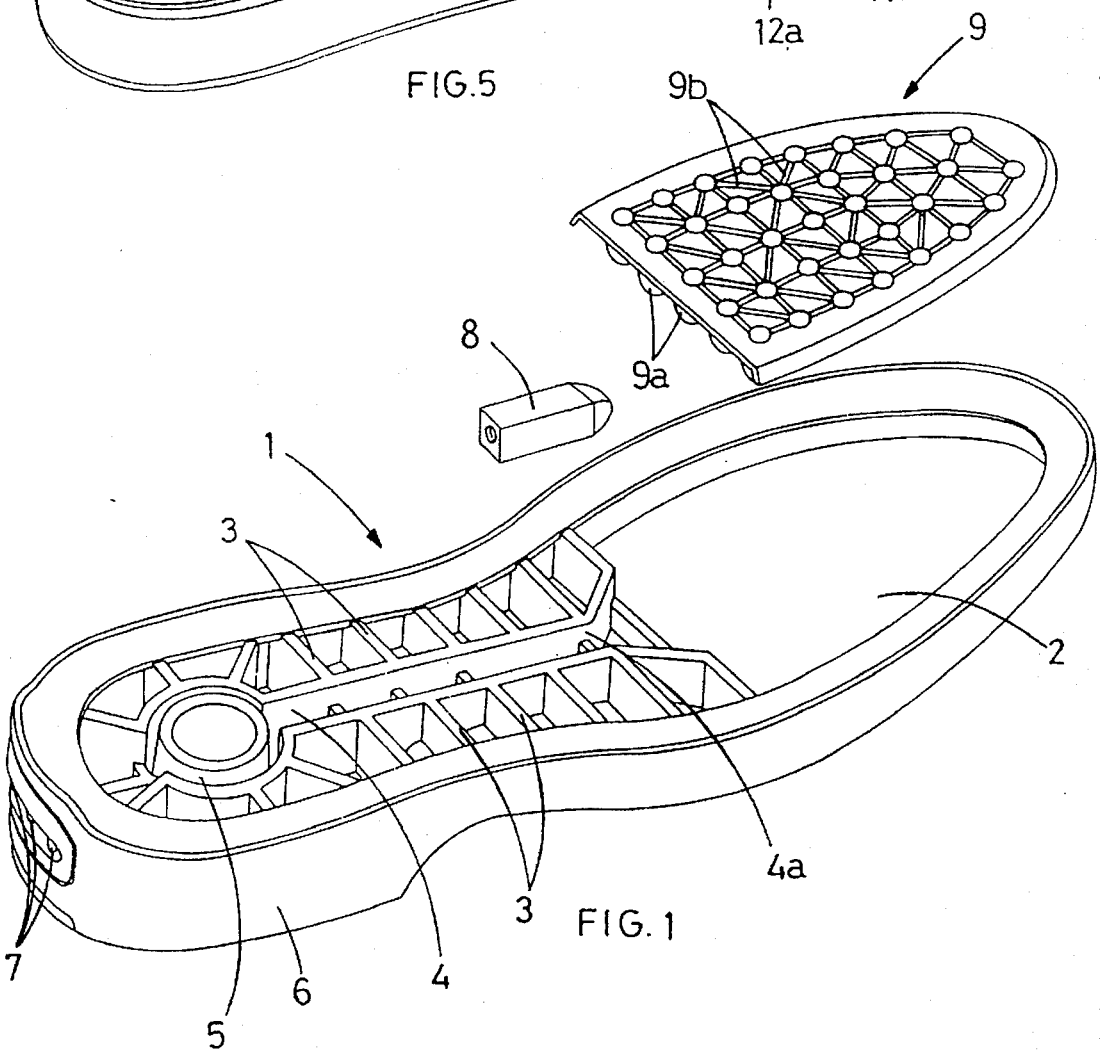
FIG. 1 shows a perspective and exploded view of the various components of the sole according to the present invention.
Figure 3:
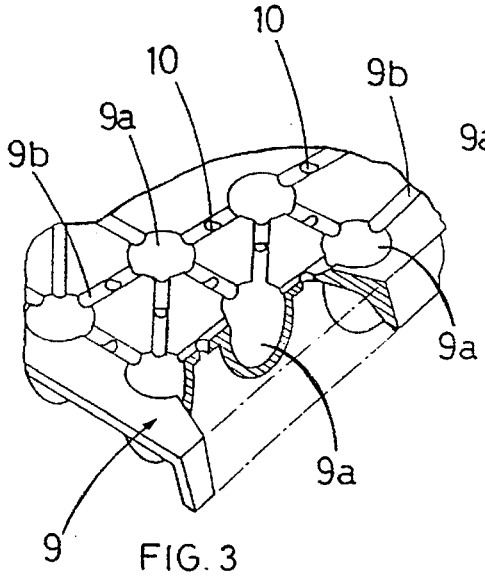
FIG. 3 is a perspective reproduction of a sectioned portion of the cushion.
Figure 2:
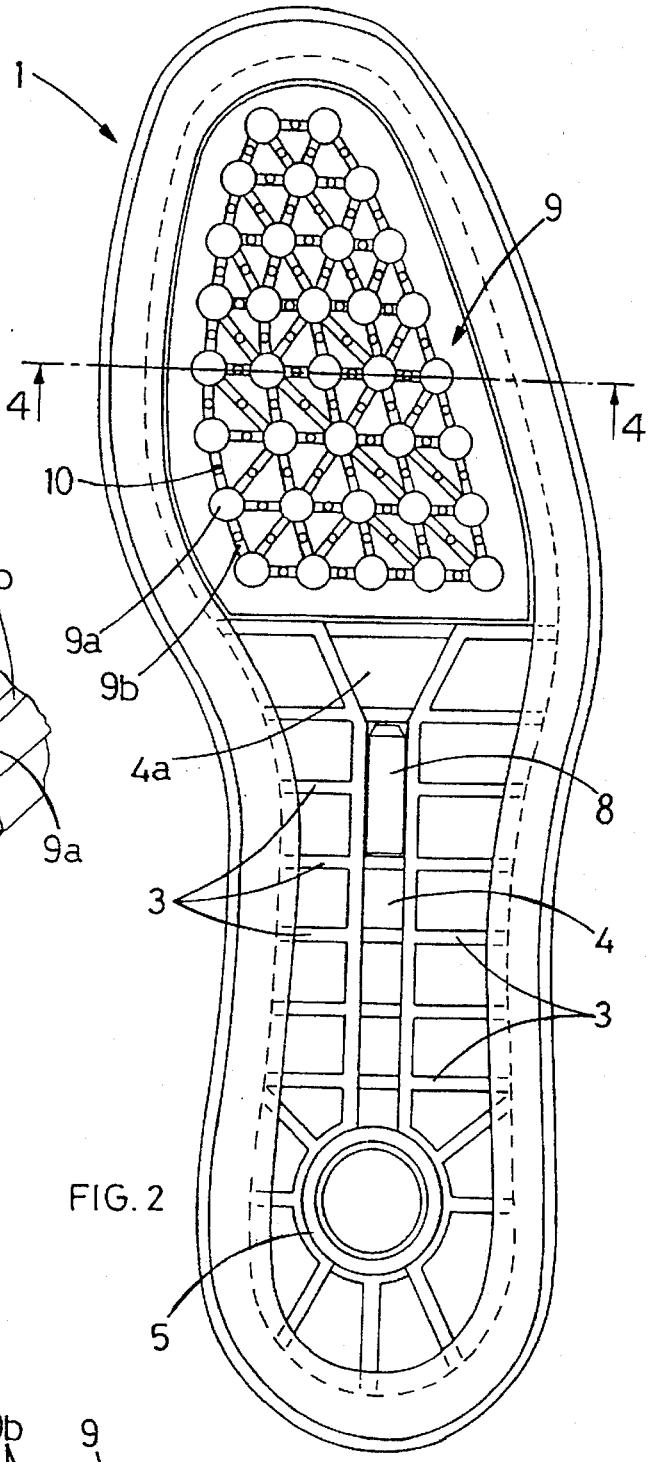
FIG. 2 is the top view of the sole according to the invention.
Figure 4:
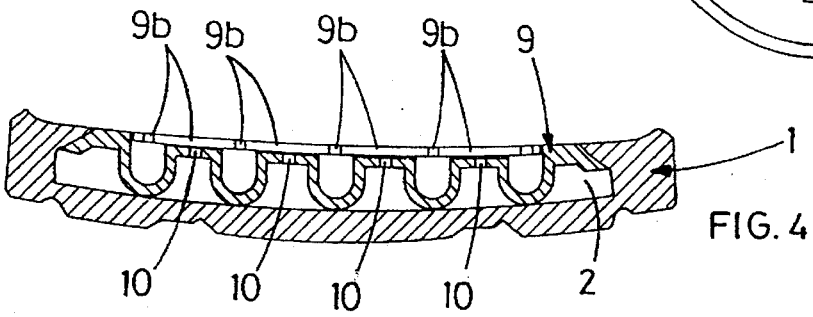
FIG. 4 is a cross section of the sole taken along the IV—IV plane of FIG. 2.

With reference to the FIGS. 1–5, the sole (1) in question is produced from moulding and has an empty pumping chamber (2) on the bottom and a network of rigid ribs (3) in the middle and at the heel.

More precisely said network is longitudinally crossed by a central chamber (4), which renders the chamber communicating with a ring (5), on the heel area (6). This ring (5) communicates with the outside by means of a series of vents (7) on the back of the heel. On the mouth (4*a*) of the channel (4), there is a single acting valve (8) of the conventional type, which allows air to flow from the chamber (2) towards the ring (5), but not in the opposite direction.

The chamber (2) precisely houses a moulded cushion (9), which has on its lower surface, a series of overturned domes (9*a*), which effectively provide support for the cushion (9), which rests on the bottom of the chamber (2) precisely on top of said domes (9*a*). The elastic deformation of the domes (9*a*) under pressure allows the cushion (9) to carry out the pumping action described above.

On the top face of the cushion (9), there is a net of surface channels (9*b*), made during moulding, which branch off radially from the cavity of each dome (9*a*) and head towards the cavity of the immediately surrounding domes (9*a*).

On the bottom of said channels (9*b*) there are through holes (10) which render the aforementioned chamber (2) communicating with the inside of the shoe, on top of the cushion (9).

It should be said that the fitted inner sole (11) and the hygienic inner sole (12), best shown in FIG. 5, are used in combination with the sole (1). A closely packed series of through holes (11*a* and 11*b*) on the bottom, provide for the air contained inside the shoe flow through the holes (10) of the cushion (9) into the chamber (2).

I claim:

1. A moulded shoe sole having a front portion, a heel area and a rear, the sole comprising:

a pumping chamber extending substantially over the front portion of the sole and having a bottom, rigid ribs extending from the pumping chamber towards the rear of the sole, a ring positioned in the heel area of the sole, an exhaust port on the rear of the sole, a single central longitudinal channel extending through the rigid ribs and connecting the pumping chamber and the ring, and an elastic cushion covering substantially the pumping chamber and having a plurality of overturned domes engaging the bottom of the pumping chamber, the cushion having a top surface including a plurality of cavities each corresponding to a respective overturned dome, adjacent cavities on the top surface of the cushion being connected by a channel having a hole protruding through the top surface of the cushion;

wherein a valve is provided within said single central longitudinal channel allowing air flow only in the direction from the pumping chamber towards the rear of the sole;

wherein a pressure applied to the top surface of the cushion causes deformation thereof and encourages the air to flow from the pumping chamber towards the exhaust port on the rear of the sole through said single central longitudinal channel; and wherein upon said pressure removal, the cushion recovers from the deformation, thereby causing a stream of air to flow from inside of the shoe to the pumping chamber through the holes protruding through the top surface of the cushion.

2. The moulded shoe sole of claim 1, wherein the sole, is an integral sole.

3. The moulded shoe sole of claim 1, wherein the exhaust port on the rear of the sole has a series of vents on the heel.

4. The moulded shoe sole of claim 1, wherein the cushion is a subject to cyclical contractions as a result of intermittent application and removal of the pressing action carried out by the ball of a foot.

* * * * *